US009868608B2

(12) United States Patent
Miura et al.

(10) Patent No.: US 9,868,608 B2
(45) Date of Patent: Jan. 16, 2018

(54) SHEET CONVEYING APPARATUS

(71) Applicant: Brother Kogyo Kabushiki Kaisha, Nagoya-shi, Aichi-ken (JP)

(72) Inventors: Katsuro Miura, Toyota (JP); Tianjin Xie, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/441,477

(22) Filed: Feb. 24, 2017

(65) Prior Publication Data

US 2017/0247216 A1 Aug. 31, 2017

(30) Foreign Application Priority Data

Feb. 25, 2016 (JP) ..... 2016-033767

(51) Int. Cl.
*B65H 29/12* (2006.01)

(52) U.S. Cl.
CPC ..... *B65H 29/12* (2013.01); *B65H 2402/54* (2013.01); *B65H 2404/24* (2013.01)

(58) Field of Classification Search
CPC ..... B65H 29/12; B65H 2301/44318; B65H 2402/232; B65H 2402/24; B65H 5/062; B65H 2404/144; B65H 2402/54
USPC ..... 271/274
See application file for complete search history.

(56) References Cited

U.S. PATENT DOCUMENTS 8,561,986 B2 * 10/2013 Kozaki ..... B65H 5/062 271/274
8,991,818 B2 3/2015 Kozaki
9,075,375 B2 * 7/2015 Tsuji ..... G03G 15/55
2004/0178571 A1 9/2004 Ohama et al.
2007/0109614 A1 * 5/2007 Iwago ..... H04N 1/00572 358/498
2014/0064752 A1 * 3/2014 Tsuji ..... G03G 15/55 399/36
2014/0151952 A1 6/2014 Kozaki

FOREIGN PATENT DOCUMENTS

JP 2004-277089 A 10/2004
JP 2014-108837 A 6/2014

* cited by examiner

*Primary Examiner* — Michael C McCullough
(74) *Attorney, Agent, or Firm* — Banner & Witcoff, Ltd.

(57) ABSTRACT

A sheet conveying apparatus, including a conveyer to convey a sheet in a predetermined conveying direction along a predetermined conveyer path, and a discharger forming a part of the conveyer to discharge the sheet from the conveyer path, is provided. The discharger includes a driving roller, a pinch roller arranged to confront the driving roller across the conveyer path, and an urging member to urge the pinch roller against the driving roller. The conveyer includes a chute member. The chute member includes a guiding face defining a part of the conveyer path, a supporting face to support one end of the urging member, and a contact face located on a particular face of the chute member opposite from the supporting face. The sheet conveying apparatus includes a plate member made of metal arranged to extend in a direction intersecting with the conveying direction and to contact the contact face.

11 Claims, 10 Drawing Sheets

SHEET CONVEYING APPARATUS

CROSS REFERENCE TO RELATED APPLICATION

This application claims priority from Japanese Patent Application No. 2016-033767, filed on Feb. 25, 2016, the entire subject matter of which is incorporated herein by reference.

BACKGROUND

Technical Field

An aspect of the present invention is related to a sheet conveyer.

Related Art

An image reading apparatus having a sheet conveyer is known. The image reading apparatus may include an auto-sheet conveyer with a sheet-discharging roller pair. The auto-sheet conveyer may convey an original sheet with an image to be read thereon along a predetermined conveyer path, and the sheet-discharging roller pair may be arranged at a most downstream position in the conveyer path.

For example, the sheet-discharging roller pair may include a driving roller, a driven roller, and an urging coil spring. The driven roller may be arranged to face the driving roller across the conveyer path, and the urging coil spring may urge the driven roller against the driving roller.

The auto-sheet conveyer may have a casing including an upper path plate and a lower path plate, which form the conveyer path inside the casing. The upper path plate and the lower path plate may be arranged to be spaced apart vertically from each other, and the original sheet may be conveyed in the intervening space. The lower path plate may include a slope surface, which faces the upper path plate, and a spring holder. The spring holder may be formed to dent downward so that the urging coil spring may be placed in the dent. The urging coil spring may be supported by a bottom face of the spring holder at a lower end thereof and may contact a shaft of the driven roller at an upper end thereof.

The original sheet conveyed by the auto-sheet conveyer in the conveyer path may be nipped by the driving roller and the driven roller in the sheet-discharging roller pair to be conveyed and discharged out of the conveyer path.

SUMMARY

With the urging coil spring urging the driven roller against the driving roller, a reaction force to the urging force from the urging coil spring may affect the bottom face of the spring holder. The reaction force affecting the bottom face of the spring holder over a long period of time may cause creep deformation in the casing. If the casing deforms, a position of the urging coil spring in the casing may move, and a compressed length of the urging coil spring may increase to be longer than a preferable length range. Therefore, a nipping force between the driving roller and the driven roller in the sheet-discharging roller pair may be lowered, and discharging ability of the sheet-discharging roller pair may not be maintained preferably.

The present disclosure is advantageous in that a sheet conveyer, in which a sheet-discharging ability by a sheet discharging device may be preferably maintained over a longer period of time, may be provided.

According to an aspect of the present disclosure, a sheet conveying apparatus, including a conveyer configured to convey a sheet in a predetermined conveying direction along a predetermined conveyer path, and a discharger configured to discharge the sheet from the conveyer path, is provided. The discharger includes a driving roller, a pinch roller arranged to confront the driving roller across the conveyer path, and an urging member configured to urge the pinch roller against the driving roller. The conveyer includes a chute member. The chute member includes a guiding face defining a part of the conveyer path, a supporting face configured to support one end of the urging member, and a contact face located on a particular face of the chute member opposite from the supporting face. The sheet conveying apparatus further includes a plate member made of metal, arranged to extend in a direction intersecting with the conveying direction and to contact the contact face.

According to another aspect of the present disclosure, a sheet conveying apparatus, including a conveyer configured to convey a sheet along a predetermined conveyer path; a driver frame made of metal configured to support a driver unit that is configured to drive the conveyer, and a discharger configured to discharge the sheet from the conveyer path, is provided. The conveyer includes a chute member having a guiding face that defines a part of the conveyer path. The sheet conveying apparatus further includes a plate member arranged to adjoin a particular face located on a side of the chute member opposite from the guiding face. The plate member is arranged to extend in a direction orthogonal to a predetermined conveying direction, in which the sheet is conveyed by the conveyer. The plate member is arranged to contact the driver frame at an end portion thereof.

BRIEF DESCRIPTION OF THE ACCOMPANYING DRAWINGS

DETAILED DESCRIPTION

Figure 1:
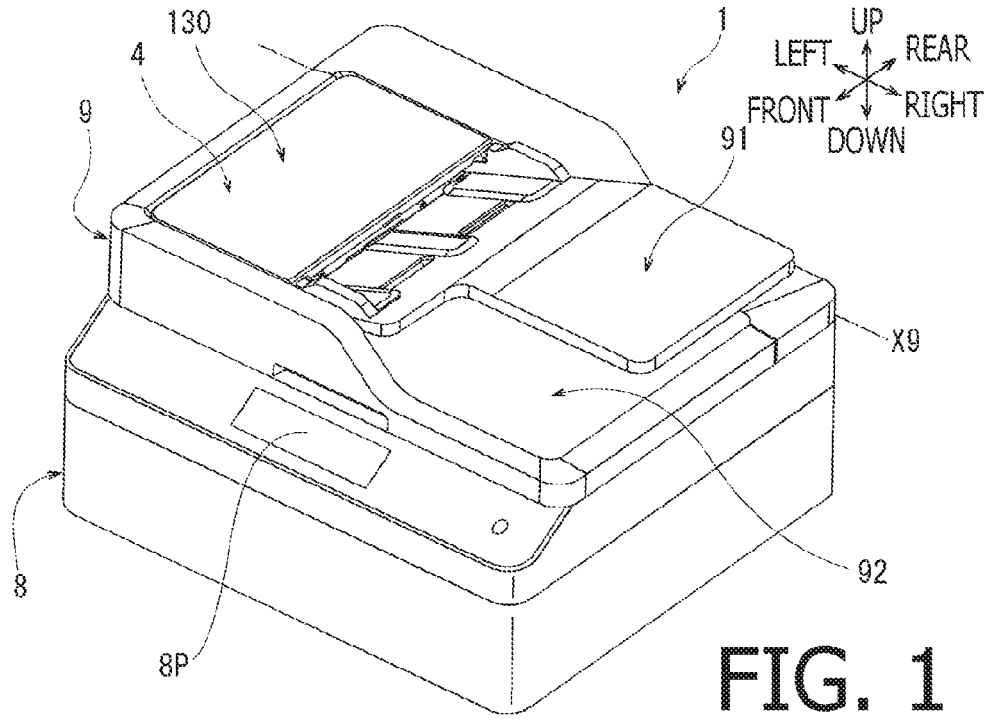
FIG. 1 is a perspective view of an image reading apparatus according to an embodiment of the present disclosure.

Hereinafter, an image reading apparatus 1 according to an embodiment of the present disclosure will be described with reference to the accompanying drawings. In the following description, directions concerning the image reading apparatus 1 and parts or components included in the image reading apparatus 1 may be mentioned based on orientations indicated by arrows shown in FIG. 1. Meanwhile, in below descriptions, in order to simply describe relative positional relations of respective units configuring the image reading apparatus 1, the upper, lower, left, right, front, and rear directions are denoted in the drawings, and the descriptions are made using the respective directions. Among the directions, the upper and lower direction is a direction perpendicular to a horizontal surface when the image reading apparatus 1 is placed on the horizontal surface, the front is a direction toward which an operation panel 8P faces, the rear is a direction opposite to the front, and the right and left direction is the right and left direction when the image reading apparatus 1 is seen from the front. However, since the directions of movable components and the like can be changed, it cannot be said that the directions denoted in the drawings are maintained all the time.

[Overall Configuration]

As shown in FIGS. 1-5, the image reading apparatus 1 includes a main body 8, an openable unit 9, an image forming unit 5, a reader unit 3, and a conveyer 4. The main body 8 may have a shape of a box, of which dimensions are smaller in height and larger depth and width. The operation panel 8P is arranged on a frontward face of the main body 8.

Figure 2:
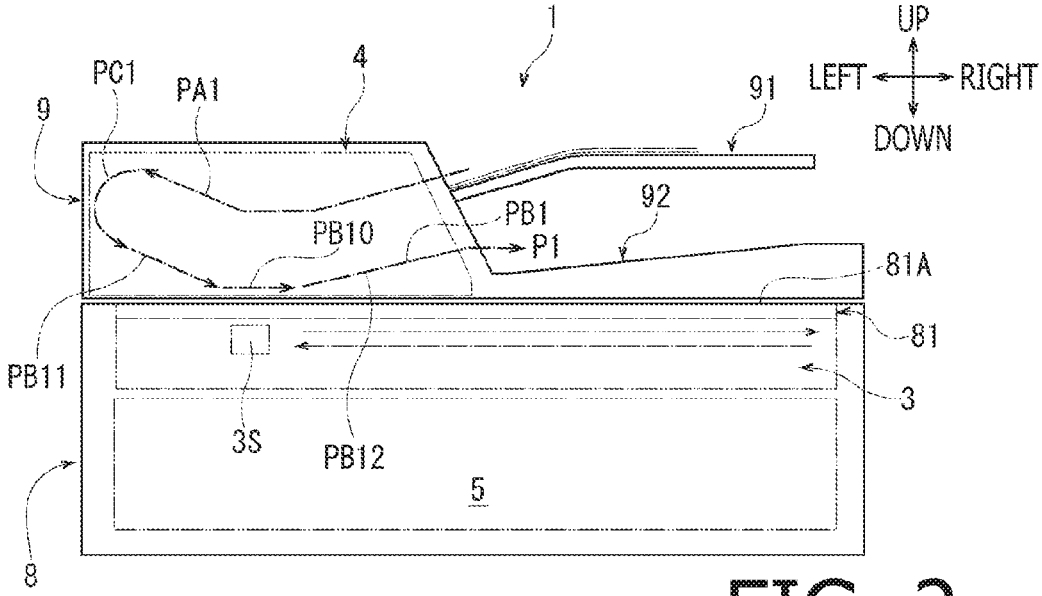
FIG. 2 is an illustrative front view of the image reading apparatus according to the embodiment of the present disclosure.

As shown in FIG. 2, the reader unit 3 is arranged in an upper position inside the main body 8, and the image forming unit 5 is arranged in a lower position inside the main body 8. The image forming unit 5 may form an image on a sheet in, for example, an inkjet-printing style or a laser-printing style.

Figure 3:
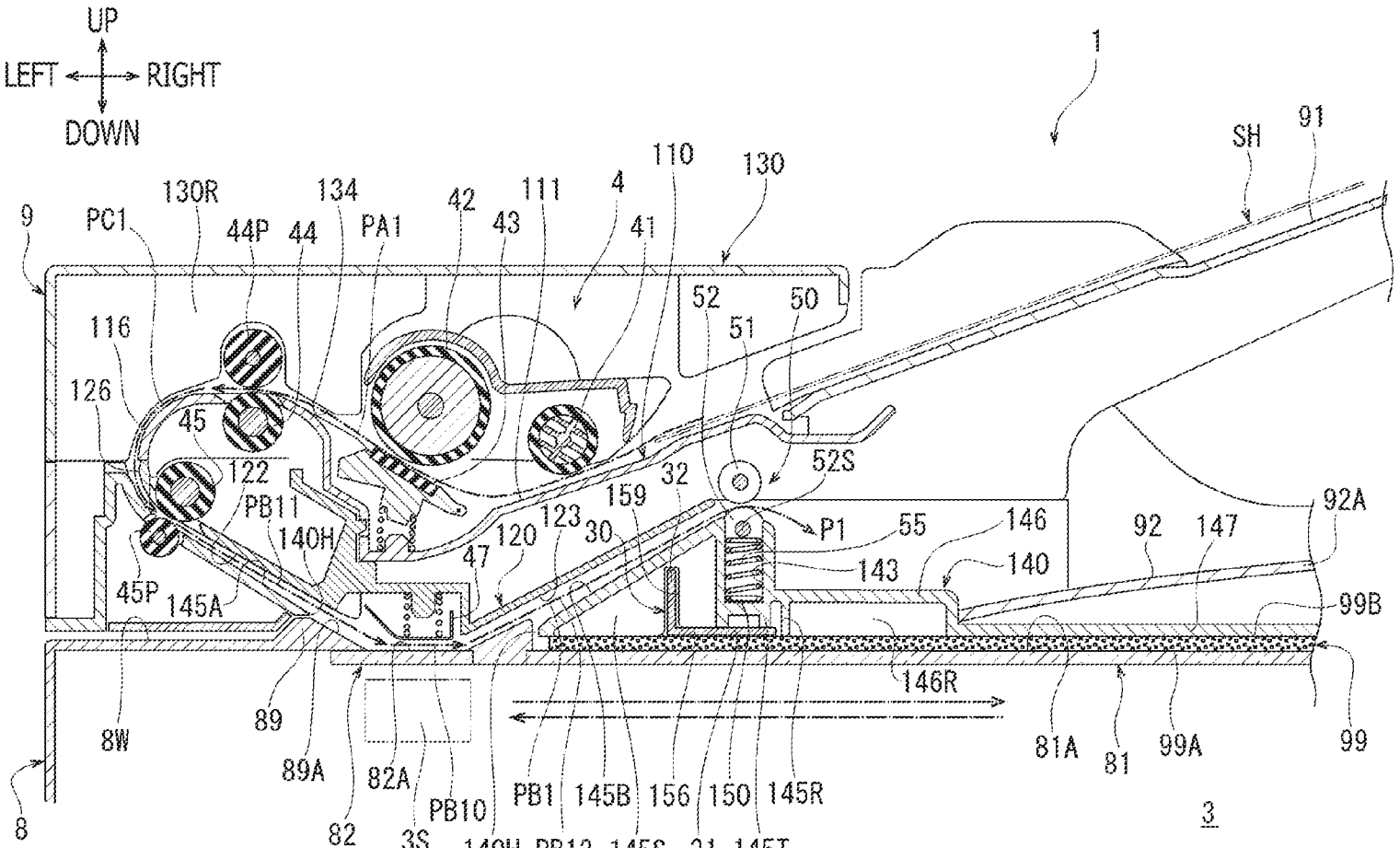
FIG. 3 is a cross-sectional partial view of the image reading apparatus according to the embodiment of the present disclosure.
Figure 5:
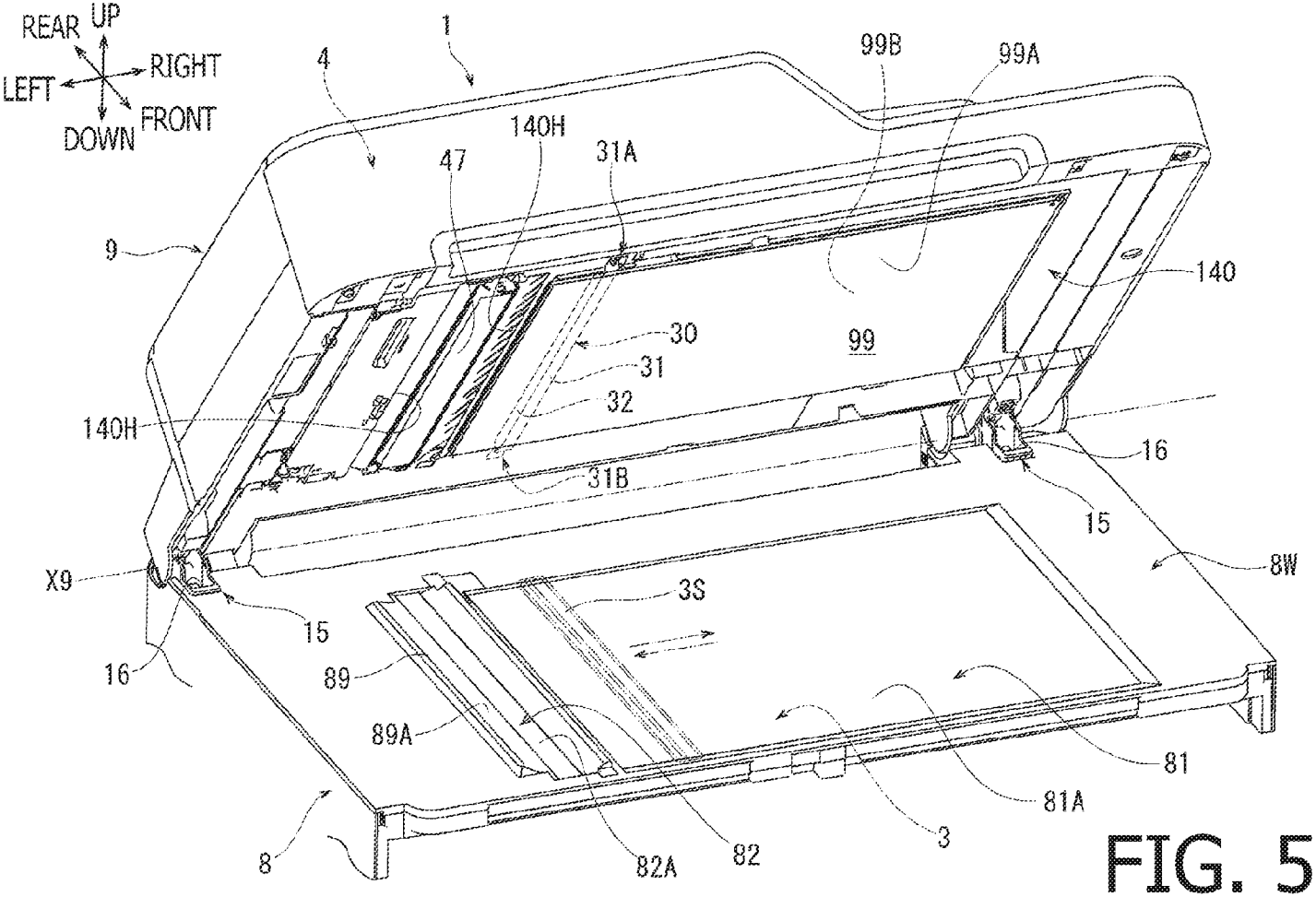
FIG. 5 is a perspective partial view of the image reading apparatus according to the embodiment of the present disclosure with an openable unit being in a second position and a sheet supporting face in a main body being exposed.

As shown in FIGS. 3 and 5, a first platen glass 81, a second platen glass 82, and a frame 8W are arranged on a top face of the main body 8.

An upper surface of the first platen glass 81 forms a sheet supporting face 81A, on which an object sheet having an image to be read by the reader unit 3 may be placed to be supported. The object sheet may include a sheet of paper, an overhead projector (OHP) film, and pages in a book.

The second platen glass 82 is arranged at a leftward position with respect to the first platen glass 81 to longitudinally extend in the front-rear direction. An upper surface of the second platen glass 82 forms a readable surface 82A, over which an object sheet SH with the image to be read may be conveyed by the conveyer 4. The readable surface 82A of the second platen glass 82 may contact the sheet SH being conveyed while the image on the object sheet SH is read by the reader unit 3.

In the following description, the object sheet with the image to be read through the sheet supporting face 81A is called as an original sheet, and an object sheet with the image to be read while being conveyed by the conveyer 4 is called as a sheet SH. However, the original sheet and the sheet SH may not necessarily be substantially different sheets but may be the same or equivalent substance.

The frame 8W is arranged to enclose the first platen glass 81 and the second platen glass 82. At a part of the frame 8W in adjacent leftward to the second platen glass 82, formed is a sloped projection 89. The sloped projection 89 protrudes upward from an upper surface of the frame 8W and extends longitudinally in the front-rear direction. The sloped projection 89 includes a sloped face 89A, which inclines to be higher on a left end portion and lower on a right end portion. In other words, the sloped face 89A inclines lower-rightward to approach the readable surface 82A.

Figure 4:
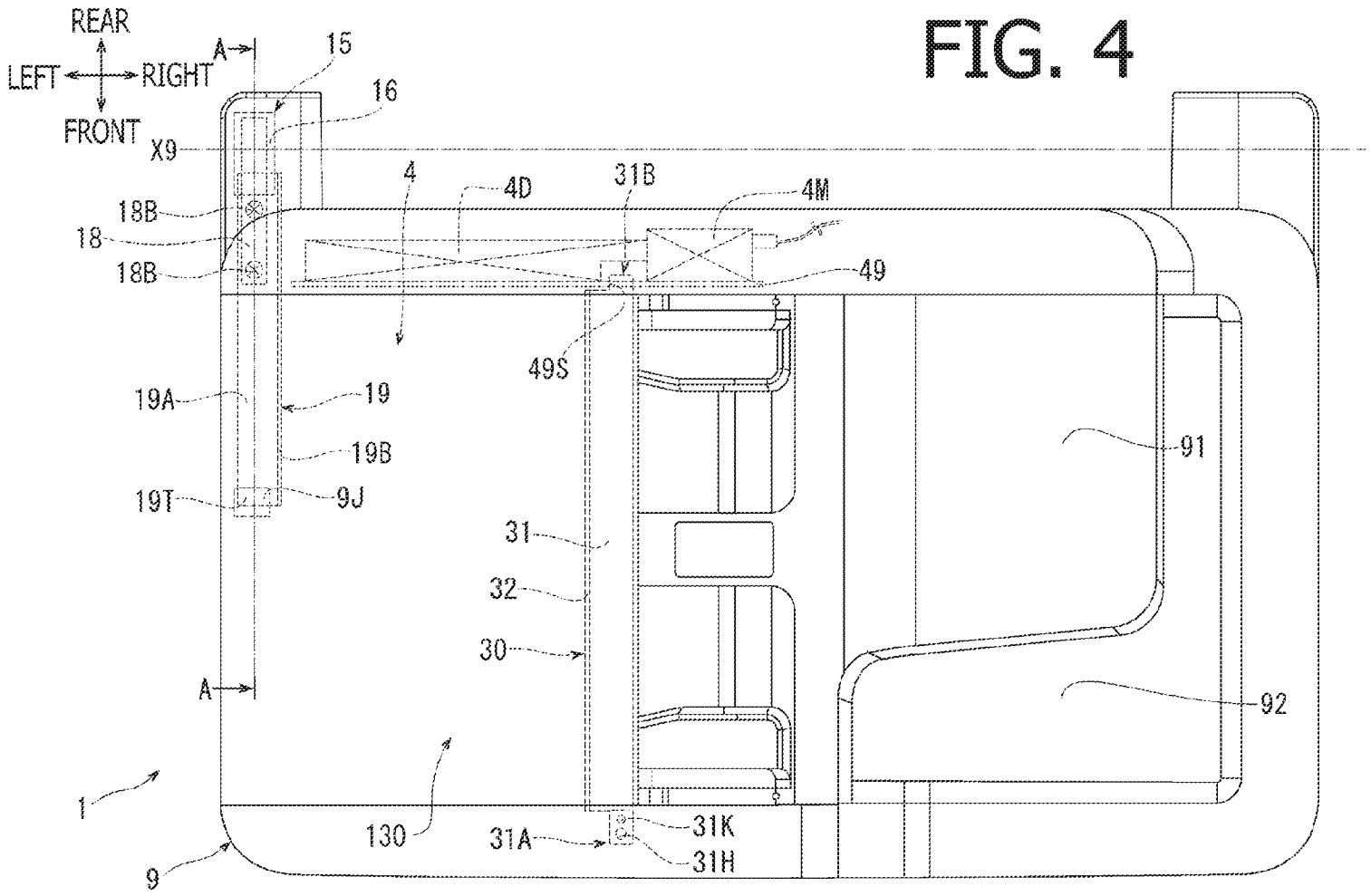
FIG. 4 is a top plan view of the image reading apparatus according to the embodiment of the present disclosure.

As shown in FIGS. 4 and 5, at each of rear-leftward and rear-rightward corners of the main body 8, arranged is a hinge 15. The openable unit 9 is supported by the hinges 15 to be swingable about an openable axis X9, which extends in the widthwise direction (the right and left direction). The openable unit 9 may be placed in a first position, as shown in FIGS. 1-4, in which the openable unit 9 may cover the sheet supporting face 81A from above. A frontward part of the openable unit 9 may be moved upper-rearward so that the openable unit 9 may swing about the openable axis X9 to be placed in a second position, as shown in FIG. 5. The openable unit 9 in the second position may expose the sheet supporting face 81A. The user may thus place the original sheet to be supported on the sheet supporting face 81A. The openable unit 9 may not only be openable (i.e., in the second position) but also be closable (i.e., in the first position).

In the following description, directions concerning items and structure in the openable unit 9 may be explained based on an orientation of the openable unit 9 in the first position.

As shown in FIGS. 2, 3, and 5, the reader unit 3 includes a reader sensor 3S and a scanner device (not shown), which are stored in upper positions in the main body 8. The reader sensor 3S may be a known image readable sensor including, but not necessarily limited to, a contact image sensor (CIS) and a charge coupled device (CCD). The reader sensor 3S is arranged to longitudinally extend in the front-rear direction, which is a main scanning direction. On an upper surface of the reader sensor 3S, arranged are a plurality of light-receivable elements aligned in line.

As shown in FIG. 3, the reader sensor 3S is arranged at a lower position with respect to the sheet supporting face 81A and the readable surface 82A. The scanner device may move the reader sensor 3S to reciprocate in the widthwise direction in a widthwise range below the sheet supporting face 81A and the readable surface 82A so that the image on the original sheet, which is supported on the sheet supporting face 81A, is read by the reader sensor 3S. Meanwhile, in order for the image on the sheet SH to be read by the reader sensor 3S, the reader sensor 3S may stay at a stationary readable position to read the image.

As shown in FIGS. 1-4, the conveyer 4 is arranged in the openable unit 9. The conveyer 4 includes a supply tray 91 and a discharge tray 92. As shown in FIGS. 1-2, the supply tray 91 is located at a rightward position in the openable unit 9. The discharge tray 92 is located at a lower position with respect to the supply tray 91.

As shown in FIGS. 2 and 3, the supply tray 91 may support the sheet SH to be conveyed by the conveyer 4 from below. The image on the sheet S may be read by the reader sensor 3S and conveyed by the conveyer 4 to be discharged to settle in the discharge tray 92.

As shown in FIG. 3, the conveyer 4 includes an upper chute member 110, a middle chute member 120, a lower chute member 140, and a cover member 130. The upper chute member 110, the middle chute member 120, the lower chute member 140, and the cover member 130 may be thermoplastic injection-molded resin members.

The conveyer 4 further includes a conveyer path P1. The conveyer path P1 is formed by the upper chute member 110, the middle chute member 120, the lower chute member 140, and the cover member 130. Specifically, the upper chute member 110, the middle chute member 120, the lower chute member 140, and the cover member 130 provide faces that define the conveyer path P1, and the sheet SH in the conveyer path P1 may be guided by the faces. The conveyer path P1 includes an upper path PA1, a curved path PC1, and a lower path PB1.

The upper path PA1 extends from the supply tray 91 to a position in proximity to a leftward end portion of the openable unit 9. The upper path PA1 inclines lower-leftward at a part, which is continuously extended from the supply tray 91, and turns to incline upper-leftward from an intermediate position between a feeder roller 41 and a separator roller 42, which will be described later in detail.

The curved path PC1 curves to bulge leftward and connects a leftward end of the upper path PA1 to a leftward end of the lower path PB1.

The lower path PB1 is located at a lower position with respect to the upper path PA1. The lower path PB1 extends from a position in proximity to the leftward end portion of the openable unit 9 to the discharge tray 92. The lower path PB1 inclines lower-rightward at the position in proximity to the leftward end portion of the openable unit 9 to be closer to the readable surface 82A, extends rightward substantially horizontally along the readable surface 82A, and turns to incline upper-rightward toward the discharge tray 92.

The lower path PB1 includes a base range PB10, which is the part of the lower path PB1 extending rightward substantially horizontally along the readable surface 82A at a lower position with respect to the curved path PC1, and a first slope range PB11 and a second slope range PB 12, which are separated from each other by the base range PB10.

The first slope range PB 11 is a part of the lower path PB1 that inclines to be lower from the position in proximity to the leftward end portion of the openable unit 9 to be closer to the readable surface 82A. In other words, the first slope range PB 11 inclines to be lower from the curved path PC 1 toward the base range PB10.

The second slope range PB 12 is a part of the lower path PB11 that inclines to be higher from the readable surface 82A toward the discharge tray 92. In other words, the second slope range PB 12 inclines to be higher from the base range PB10 toward a side opposite to the curved path PC1.

The conveyer 4 may convey the sheet SH in the conveyer path P1, in particular, from the upper path PA1 through the curved path PC1 to the lower path PB1. A conveying direction to convey the sheet SH in the conveyer path P1 is leftward in the upper path PA1, turns from leftward to rightward in the curved path PC1, and is rightward in the lower path PB1. Therefore, in the present embodiment, a rightward end of the upper path PA1 is a most upstream end of the conveyer path P1, and a rightward end of the lower path PB1 is a most downstream end of the conveyer path P1, with regard to the conveying direction. Meanwhile, a direction of width of the sheet SH in the conveying path P1 may intersect orthogonally to the conveying direction and correspond to the front-rear direction of the image reading apparatus 1.

An upper surface of the upper chute member 110 forms a first guiding face 111, which defines the upper path PA. The sheet SH conveyed in the upper path PA1 may contact the first guiding face 111 so that the first guiding face 111 may guide the sheet SH from below.

At a leftward end portion of the upper chute member 110, formed is an upper curve face 116. The upper curve face 116 defines an upper part of the curved path PC1. The sheet SH conveyed in upper part of the curved path PC1 may contact the upper curve face 116 so that the upper curve face 116 may guide the sheet SH from below and from the right.

The middle chute member 120 is arranged to confront the upper chute member 110 from below. At a leftward end portion of the middle chute member 120, formed is a lower curve face 126. The lower curve face 126 defines a lower part of the curved path PC1. The sheet SHI conveyed in the lower part of the curved path PC may contact the lower curve face 126 so that the lower curve face 126 may guide the sheet SH from the right and from above.

A lower face of the middle chute member 120 extends continuously from the lower curve face 126 and inclines lower-rightward. The middle chute member 120 forms a second guiding face 122, which defines the first slope range PB11 in the lower path PB1, by the lower face thereof. The sheet SH conveyed in the first slope range PB11 may contact the second guiding face 122 so that the second guiding face 122 may guide the sheet SHI from above.

To the lower face of the middle chute member 120, attached is a sheet presser 47. The sheet presser 47 is arranged in adjacent rightward to the second guiding face 122 to confront the readable surface 82A from above. The sheet presser 47 is urged by an urging spring (unsigned) toward the readable surface 82A. A lower face of the sheet presser 47 defines the base range PB10 in the lower path PB1. The sheet SH conveyed in the base range PB10 may contact the lower face of the sheet presser 47 so that the sheet presser 47 may guide the sheet SH from above.

The lower face of the middle chute member 120 inclines upper-rightward from a position adjacent rightward to the sheet presser 47. The middle chute member 120 forms a third guiding face 123, which defines the second slope range PB 12 in the lower path PB1 by the lower face. The sheet SH conveyed in the second slope range PB12 may contact the third guiding face 123 so that the third guiding face 123 may guide the sheet SH from above.

The cover member 130 is arranged to confront the upper chute member 110 from above. On a lower face of the cover member 130, formed are a plurality of ribs 130R. The cover member 130 form a fourth guiding face 134 by lower ends of the ribs 130R. The fourth guiding face 134 defines the upper part of the upper path PA1 and the upper part of curved path PC1. The sheet SH conveyed in the upper path PA1 and the upper part of the curved path PC1 may contact the fourth guiding face 134 so that the fourth guiding face 134 may guide the sheet SH from above and from the left.

Figure 6:
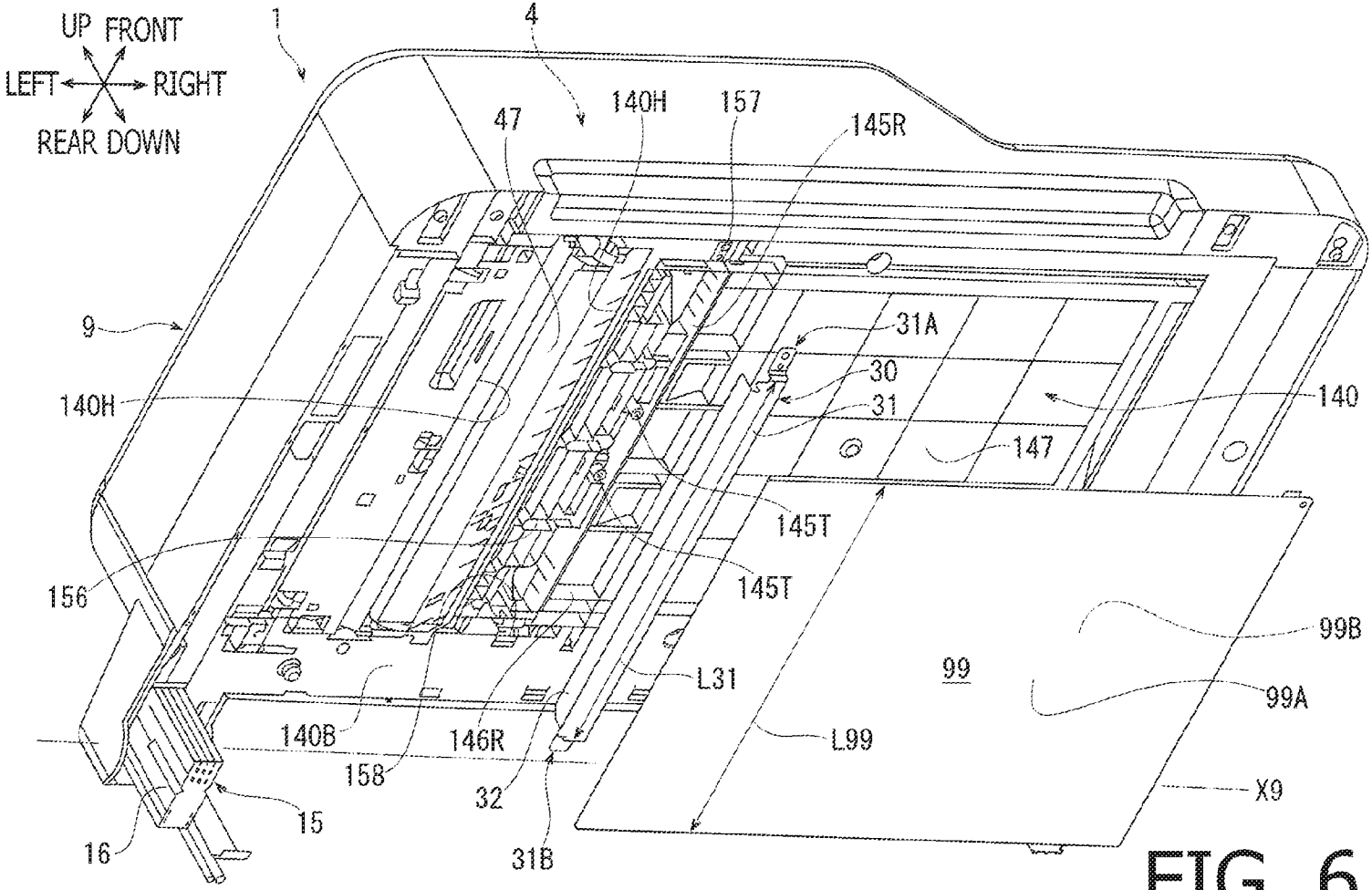
FIG. 6 is an exploded view of the openable unit in the image reading apparatus according to the embodiment of the present disclosure with a presser member and a plate member displaced from the openable unit.

The lower chute member 140 is arranged to confront the upper chute member 110 and the middle chute member 120 from below. As shown in FIGS. 3 and 6, the lower chute member 140 forms a bottom face of the openable unit 9. As shown in FIG. 3, the lower chute member 140 may, when the openable unit 9 is in the first position, cover the sheet supporting face 81A from above.

Figure 7:
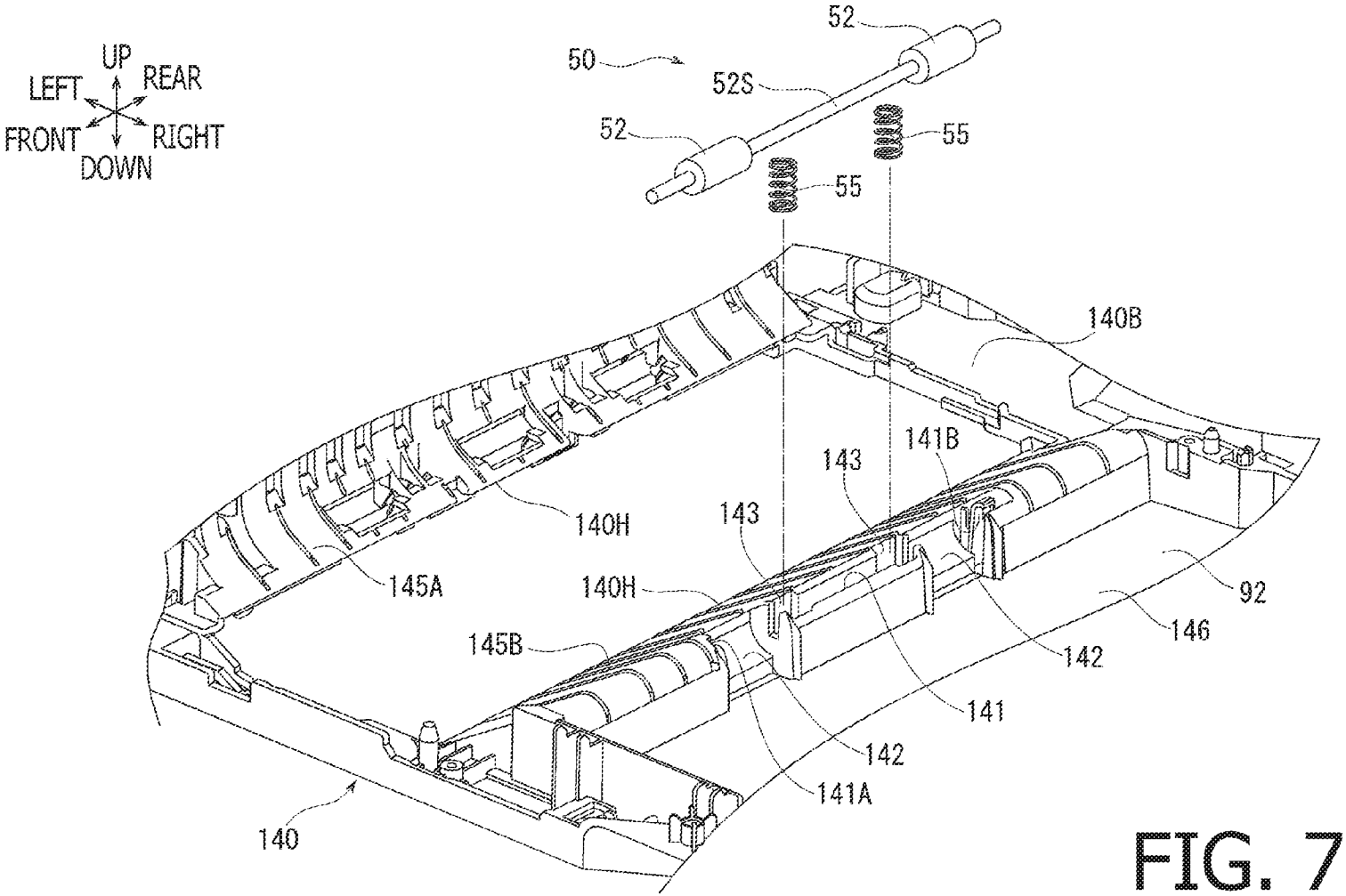
FIG. 7 is a perspective partial view of a lower chute member in the image reading apparatus according to the embodiment of the present disclosure with pinch rollers and compressive coil springs being displaced from the lower chute.

As shown in FIGS. 3 and 7, the lower chute member 140 includes an opening 140H, which is formed through the lower chute member 140 vertically, at a leftward position in the lower chute member 140. In particular, as shown in FIG. 3, the opening 140H is formed at a position in the lower chute member 140 above an area, in which the reader sensor 3S in the stationary readable position is located. As shown in FIGS. 5 and 6, the opening 140H is formed in an approximate shape and a size of an elongated rectangle, through which the sheet presser 47 may be exposed, longitudinally along the front-rear direction.

As shown in FIGS. 3 and 7, fifth guiding faces 145A, 145B are formed on both sides of the opening 140 along the widthwise direction. Specifically, at a leftward position with respect to the opening 140 H in the lower chute member 140, formed is a fifth guiding face 145A on the left, and at a rightward position with respect to the opening 14011 in the lower chute member 140, formed is a fifth guiding face 145B on the right.

As shown in FIG. 3, a leftward part of the fifth guiding face 145A defines the lower part of the curved path PC1. The sheet SH conveyed in the lower part of the curved path PC may contact the leftward part of the fifth guiding face 145A so that the leftward part of the fifth guiding face 145A may guide the sheet SH in the lower part of the curved path PC1 and the first slope range PB11 in the lower path PB1 from the left and from below. A rightward part of the fifth guiding face 145A inclines lower-rightward along the first slope range PB11 to be connected to a leftward end of sloped face 89A of the sloped projection 89 formed in the frame 8W. The rightward part of the fifth guiding face 145A and the sloped face 89A define the first slope range PB11. The sheet SH conveyed in the first slope range PB11 may contact the rightward part of the fifth guiding face 145A and the sloped face 89A so that the fifth guiding face 145A and the sloped face 89A may guide the sheet SH in the first slope range PB11 in the lower path PB1 from below.

The fifth guiding face 145B defines the second slope range PB 12 in the lower path PB1. The sheet SH conveyed in the second slope range PB12 in the lower path PB1 may contact the fifth guiding face 145B so that the fifth guiding face 145 may guide the sheet SH from below.

In the lower chute member 140, at a rightward position with respect to the fifth guiding face 145B, formed is a step part 146, and at a rightward position with respect to the step part 146, formed is a flat part 147. The flat part 147 spreads substantially flat at a rightward part in the lower chute member 140. The step part 147 is formed to be lower than a rightward end of the fifth guiding face 145B and higher than the flat part 147. On an upper side of the flat part 147, arranged is a tray member 92A. An upper face of the step part 146 and an upper face of the tray member 92A form the discharge tray 92.

Figure 8:
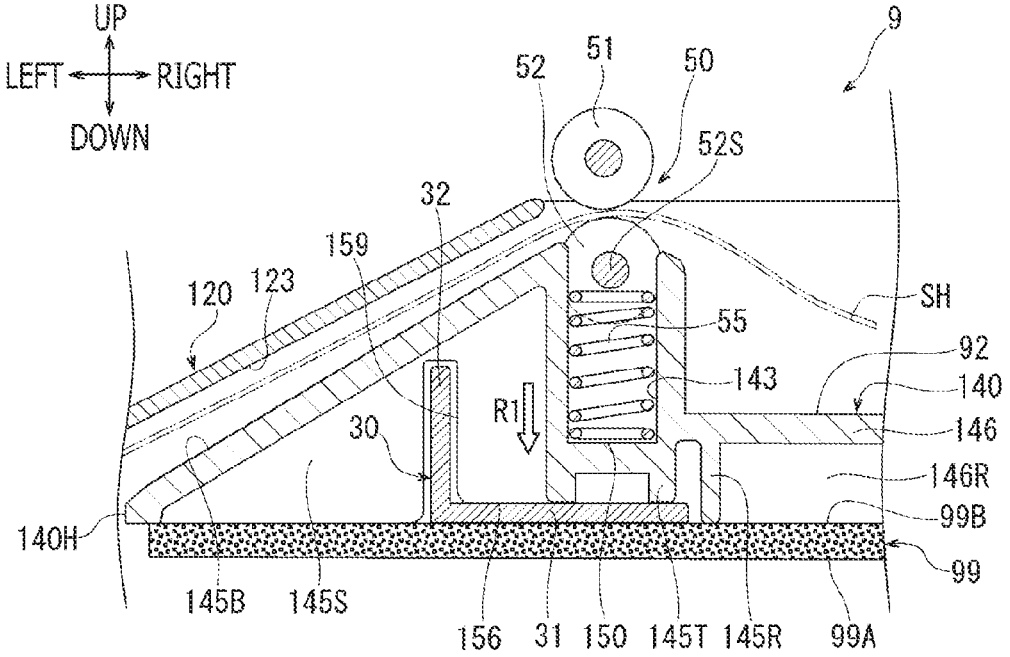
FIG. 8 is a cross-sectional partial view of a discharge unit in the image reading apparatus according to the embodiment of the present disclosure.

As shown in FIGS. 3, 6, and 8, in the lower chute member 140, on an opposite side from the fifth guiding face 145B, formed are a plurality of enhancing ribs, which include a rib 145R, ribs 145S, and two (2) cylindrical parts 145T, which droop from a lower surface of the lower chute member 140 to protrude downward. Further, in the lower chute member 140, on an opposite side from the step part 146, formed are a plurality of enhancing ribs including ribs 146R, which droop from a lower surface of the lower chute member 140 to protrude downward.

The rib 145R is formed at a lower position with respect to a rightward end of the fifth guiding face 145B to extend in the front-rear direction. The ribs 145S are formed at positions spaced apart from one another along the front-rear direction to extend in the widthwise direction. A rightward end of each rib 145S is connected to the rib 145R. The cylindrical parts 145T are formed at positions spaced apart leftward from the rib 145R. The ribs 146R are arranged to be spaced apart from one another along the front-rear direction and extend in the widthwise direction. A leftward end of each rib 146R is connected to the rib 145R.

A plane that includes a lower surface of the flat part 147 and lower edges of the plurality of enhancing ribs, including the ribs 145R, 145S, and 146R and lower edges of the cylindrical parts 145T, forms a bottom face of the lower chute member 140.

As shown in FIGS. 3, 5, and 6, a part of the bottom face of the lower chute member 140 on a rightward side with respect to the opening 140 is covered by a presser member 99. The presser member 99 is a sheet made of a compressively deformable material such as sponge and is formed in a rectangular shape with shorter sides and longer sides, which are in dimensions substantially equal to those of the sheet supporting face 81A.

As shown in FIG. 3, when the openable unit 9 is in the first position, the presser member 99 may cover the first platen glass 81 from above. The presser member 99 in this position may place a surface 99A thereof to confront and contact the original sheet supported on the first platen glass 81 so that the original sheet may be pressed against the sheet supporting face 81A.

With the openable unit 9 in the first position, the opening 140H is placed at a position straight above the readable surface 82A so that the readable surface 82A may confront the sheet presser 47. In this arrangement, the readable surface 82A defines the base range PB10 in the lower path PB1. The sheet SH conveyed in the base range PB10 may contact the readable surface 82A so that the sheet SH in the base range PB10 may be guided by the readable surface 82A from below. In this regard, the first slope range PB11 inclined to be lower from the curved path PC1 toward the base range PB10 may be expressed in other words that the first slope range PB11 inclines from the curved path PC1 toward the reader sensor 3S staying at the stationary readable position.

The conveyer 4 includes a driver frame 49 and a driver unit 4D, as shown in FIG. 4. The conveyer 4 further includes, as shown in FIG. 3, the feeder roller 41, the separator roller 42, a separator piece 43, a first conveyer roller 44, a first pinch roller 44P, a second conveyer roller 45, and a second pinch roller 45P. Furthermore, the conveyer 4 includes a discharge unit 50, as shown in FIGS. 3, 7, and 8. The discharge unit 50 includes two (2) sets of a driving roller 51, a pinch roller 52, and a compressive coil spring 55.

The driver frame 49 may be a piece of metal board. Although detailed illustration thereof is omitted, the driver frame 49 is attached to a rear end portion 140B of the lower chute member 140 (see FIGS. 6 and 7), at a rearward position with respect to the opening 140. As shown in FIG. 4, the driving frame 49 is arranged to spread in the widthwise direction and the vertical direction at a rearward position in the openable unit 9. A leftward end of the driver frame 49 is at a position in the vicinity of the leftward end portion of the openable unit 9, and a rightward end portion of the driving frame 49 is at a widthwise intermediate position in the openable unit 9. The driver frame 49 may be connected with a ground wire, which is not shown.

The driver unit 4D is supported by the driving frame 49. The driver unit 4D includes a motor 4M and a plurality of gears that may transmit a driving force from the motor 4M to movable components including the feeder roller 41, the separator roller 42, the first conveyer roller 44, the second conveyer roller 45, and the driving roller 51. Although detailed illustration of those are omitted, the gears are coupled with rotation shafts of the feeder roller 41, the separator roller 42, the first conveyer roller 44, the second conveyer roller 45, and the driving roller 51, which are shown in FIG. 3, respectively. Thus, the driver unit 4D may drive the feeder roller 41, the separator roller 42, the first conveyer roller 44, the second conveyer roller 45, and the driving roller 51 by the motor 4M.

As shown in FIG. 3, the feeder roller 41, the separator roller 42, and the separator piece 43 are arranged at positions closer within the upper path PA1 to the supply tray 91 than the other rollers.

The feeder roller 41 and the separator roller 42 are arranged at positions to vertically confront the first guiding face 111 of the upper chute member 110 from above. The separator piece 43 is arranged to vertically confront the separator roller 42 from below. The separator piece 43 may be a plate made of flexible material such as rubber or elastomer. The separator piece 43 is pressed by a spring (unsigned) against the separator roller 42.

The feeder roller 41 may apply a conveying force to the sheets SH supported on the supply tray 91 to convey the sheet SH toward the separator roller 42. The separator roller 42 may contact the sheets SIT conveyed in the upper path PA1 from the supply tray 91 and rotate to convey one of the sheets SH toward the curved path PC1. The separator piece 43 may separate the sheet SH conveyed by the separator roller 42 from the other sheets SH in conjunction with the separator roller 42.

The first conveyer roller 44 and the first pinch roller 44P are arranged in the upper path PA1 at leftward positions with respect to the separator roller 42 and the separator piece 43, i.e., on a downstream side of the separator roller 42 and the separator piece 43 with regard to the conveying direction. The first conveyer roller 44 is arranged to be partly exposed from the first guiding face 11. The first pinch roller 44P is arranged to be partly exposed from the fourth guiding face 134. The first conveyer roller 44 and the first pinch roller 44P may nip the sheet SH separated by the separator roller 42 and the separator piece 43 to convey the sheet SH toward the curved path PC1.

The second conveyer roller 45 and the second pinch roller 45P are arranged in the lower part of the curved path PC1. The second conveyer roller 45 is arranged to be partly exposed from the lower curve face 126. The second pinch roller 45P is arranged to be partly exposed from the fifth guiding face 145A.

The second conveyer roller 45 and the second pinch roller 45P may nip the sheet SH conveyed by the first conveyer roller 44 and the first pinch roller 44P to convey the sheet SH toward the reader sensor 3S, which is placed at the stationary readable position to confront the base range PB10. The sheet SH being conveyed in the base range PB10 may be restrained from floating over the readable surface 82A by the sheet presser 47.

As shown in FIGS. 3 and 8, the driving rollers 51 and the pinch rollers 52 in the discharge unit 50 are arranged at a rightward end of the second slope range PB12 in the lower path PB1. The driving rollers 51 are arranged to adjoin the third guiding face 123, and the pinch rollers 52 are arranged to adjoin the fifth guiding face 145. The pinch rollers 52 confront the driving roller 51 across the conveyer path P1.

Although detailed illustration of those is omitted, the driving rollers 51 are arranged to be spaced apart from each other along the front-rear direction. As shown in FIG. 7, each pinch roller 52 is arranged to confront the corresponding one of the driving rollers 51 from below at the spaced apart positions along the front-rear direction. Specifically, at a rightward end of the fifth guiding face 145B in the lower chute member 140, a shaft housing 141, two (2) pinch roller housings 142, and two (2) spring housings 143 are formed to dent downward. A frontward one of the spring housings 143 is in adjacent rearward to a frontward one of the pinch roller housings 142. A rearward one of the spring housings 143 is in adjacent frontward to a rearward one of the pinch roller housings 142. The shaft housing 141 is formed to extend longitudinally in the front-rear direction penetrating through the spring housings 143 and the pinch roller housings 142. On a frontward end of the shaft housing 141, formed is a shaft-end support 141A. On a rearward end of the shaft housing 141, formed is a shaft-end support 141B. The shaft-end support 141A on the front is in adjacent frontward to the frontward one of the pinch roller housings 142. The shaft-end support 141B on the rear is in adjacent rearward to the rearward one of the pinch roller housings 142.

The support shaft 52S is arranged in the shaft housing 141. In the shaft housing 141, the shaft-end support 141A on the front may support a frontend portion of the support shaft 52S with allowance for the frontend portion of the support shaft 52S to move vertically, and the shaft-end support 141B on the rear may support a rear end portion of the support shaft 52S with allowance for the rear end portion of the support shaft 52S to move vertically. Therefore, the support shaft 52S is vertically movable within the shaft housing 141. The pinch rollers 52, with the support shaft 52S rotatably penetrating there-through, are arranged in the pinch roller housings 142.

As shown in FIG. 8, the spring housing 143 each is a hole with a bottom that form a cylindrically-shaped inner room. An upward surface of the bottom of the spring housing 143 forms a supporting face 150. Each cylindrical part 145T is formed continuously from a lower face of the bottom of the spring housing 143 to protrude downward.

In each of the spring housings 143, arranged is one of the compressive coil springs 55. A lower end of the compressive coil spring 55 is supported by the supporting face 150. An upper end of the compressive coil spring 55 is arranged to contact the support shaft 52S from below in a compressed condition. Thus, the compressive coil springs 55 urge the pinch rollers 52 against the driving roller 51 through the support shaft 52S.

The driving rollers 51 and the pinch rollers 52 may nip the sheet SH passed over the readable surface 82A and convey the sheet SH toward the discharge tray 92 to discharge out of the lower path PB1.

In the present embodiment, with the configuration of the conveyer path P1 described above, the second slope range PB12 in the lower path PB1 may incline upward at a relatively large angle; therefore, a conveyance resistance in the sheet SH being conveyed in the lower path PB1 may tend to increase. Therefore, the urging force of each compressive coil spring 55 may be set to be substantially intense so that the sheet SH passed over the readable surface 82A may be caught and nipped by the driving rollers 51 and the pinch rollers 52 firmly.

[Image Reading Operation]

In order to read an original image of the original sheet supported on the sheet supporting face 81A, the reader sensor 3S in the reader unit 3 may be moved by the scanner device from a read-start position, which is below a leftward edge of the sheet supporting face 81A, to a read-end position, which is below a rightward edge of the sheet supporting face 81A, along the widthwise direction. The reader sensor 3S being moved may read the image of the original sheet supported on the sheet supporting face 81A. Thereafter, the scanner device may move the reader sensor 3S from the rightward end to the leftward end of the reader unit 3S to return to a standby position.

On the other hand, in order to read an image of the sheet SH being conveyed by the conveyer 4 from the supply tray 91, the reader sensor 3S in the reader unit 3 may be moved by the scanner device to the stationary readable position, which is below the readable surface 82A, and stopped thereat. The readable sensor 3S is placed to confront the base range PB10 in the lower path PB1 at the stationary readable position.

Meanwhile, the conveyer 4 may activate the motor 4M in the driver unit 4D to drive the feeder roller 41, the separator roller 42, the first conveyer roller 44, the second conveyer roller 45, and the driving roller 51 via the gears in the driver unit 4D. Thereby, the sheets SH on the supply tray 91 may be conveyed sequentially in the conveyer path P1. The sheets SH being conveyed may pass through the upper path PA1 and the curved path PC1 to reach the lower path PB1, whereat the reader sensor 3S staying at the stationary readable position may read the images of the sheets SH passing through the base range PB10. The sheets SH with the images having been read by the reader sensor 3S may be conveyed through the second slope range PB12, nipped by the driving rollers 51 and the pinch rollers 52 in the discharge unit 50 to be conveyed further, and ejected at the discharge tray 92. Thereafter the scanning device may move the reader sensor 3S to return to the standby position.

[Configuration of Plate Member]

As shown in FIGS. 3, 5, 6, and 8-11, the image reading apparatus 1 includes a plate member 30 made of metal. In the following description, directions concerning parts and structure in the plate member 30 will be explained based on an orientation of the plate member 30 attached to the lower chute member 140 in the openable unit 9 being in the first position.

Figure 9:
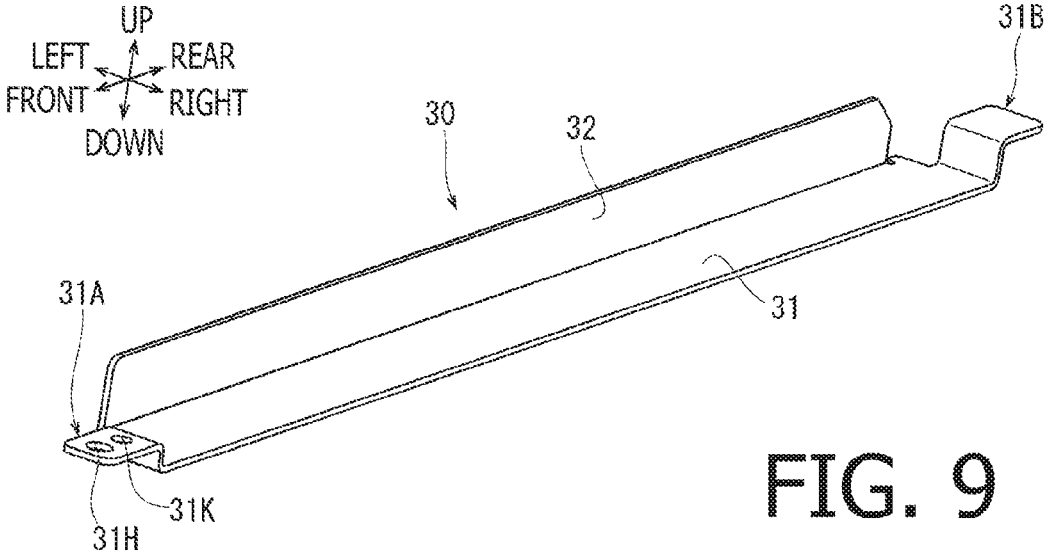
FIG. 9 is a perspective view of the plate member according to the embodiment of the present disclosure.

The plate member 30 may be a sheet of metal formed by, for example, punch-cutting and bending. As shown in FIGS. 8 and 9, the plate member 30 includes a first face 31 and a second face 32 arranged in a cross-sectional approximate shape of an L.

The first face 31 is a surface of a part of the plate member 30 that extends longitudinally in a direction intersecting with the direction to convey the sheet SIT i.e., along the front-rear direction. As shown in FIG. 6, a length L31 of the first face 31 in the front-rear direction is greater than a dimension L99 of the shorter sides of the presser member 99 in the front-rear direction.

As shown in FIGS. 8 and 9, the second face 32 is continuous with a leftward edge of the first face 31. The second face 32 is a surface of a part of the plate member 30 that extends upward and longitudinally along the front-rear direction. The upward direction along which the second face 32 extends is a direction intersecting with the first face 31 and nearing the conveyer path P1.

As shown in FIG. 9, a frontend portion 31A in the plate member 30 is formed by bending the plate member 30 upward at a frontward end of the first face 31 and frontward to extend frontward. The frontend portion 31A includes a fastening hole 31H and a positioning hole 31K, which are formed vertically through the frontend portion 31A. Meanwhile, a rear end portion 31B in the plate member 30 is formed by bending the plate member 30 upward at a rear end of the first face 31 and rearward to extend rearward.

As shown in FIGS. 6 and 8, the lower chute member 140 includes a contact face 156. The contact face 156 is located on a lower side of the lower chute member 140, which is on an opposite side from the fifth guiding face 145B and the supporting face 150, that is, particularly on a bottom side of the lower chute member 140. The contact face 156 is a plane hypothetically spreading along lower edges of rightward parts of the ribs 145S and lower edges of the cylindrical parts 145T. The contact face 156 extends longitudinally along the front-rear direction at a leftward position with respect to the rib 145R.

As shown in FIG. 8, each of the ribs 145S is formed to have a groove that is indented upward from the lower edge thereof, and the grooves formed in the ribs 145S form a dent 159 that is elongated in the front-rear direction. In other words, the dent 159 is a room rising upward from the contact face 156 and extending in the front-rear direction.

As shown in FIG. 8, a vertical position of the lower edges of the ribs 145 differs between a leftward side and a rightward side with respect to the dent 159. That is, the lower edges of the ribs 145 on the leftward side with respect to the dent 159 is at a lower position, and the lower edges of the ribs 145 on the rightward side with respect to the dent 159 is at a higher position. The vertical difference between the rightward side and the leftward side of lower edges of the ribs 145 may be substantially equal to a thickness of the part of the plate member 30 where the first face 31 is arranged.

Figure 10:
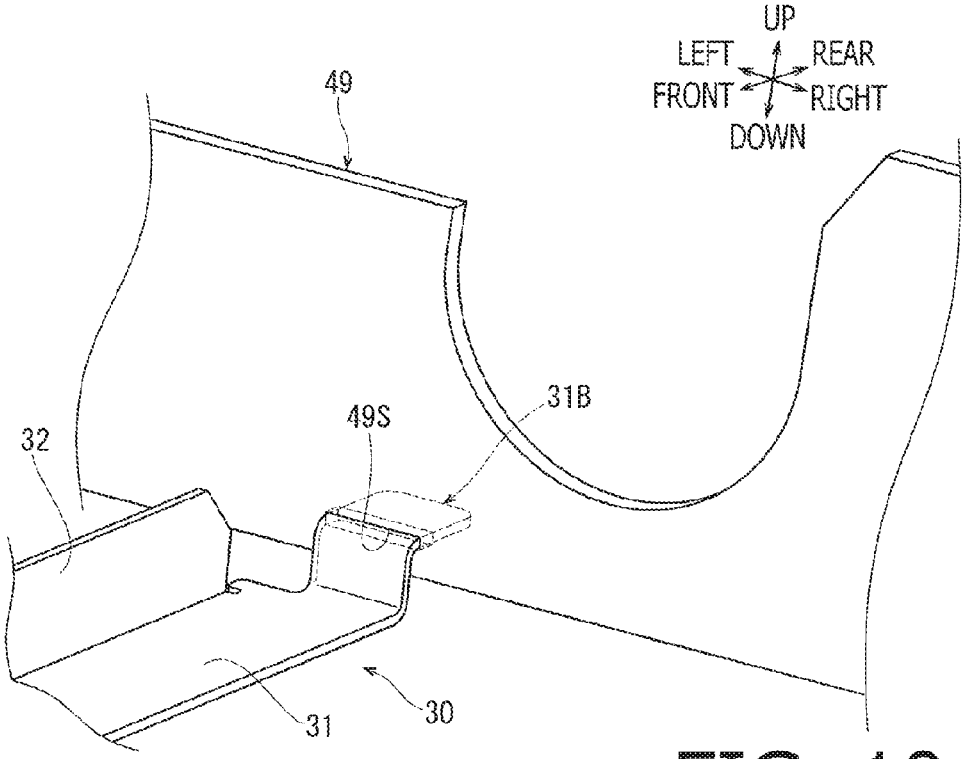
FIG. 10 is a perspective partial view of the plate member with a rearward end inserted in a slit in a driver frame in the image reading apparatus according to the embodiment of the present disclosure.
Figure 11:
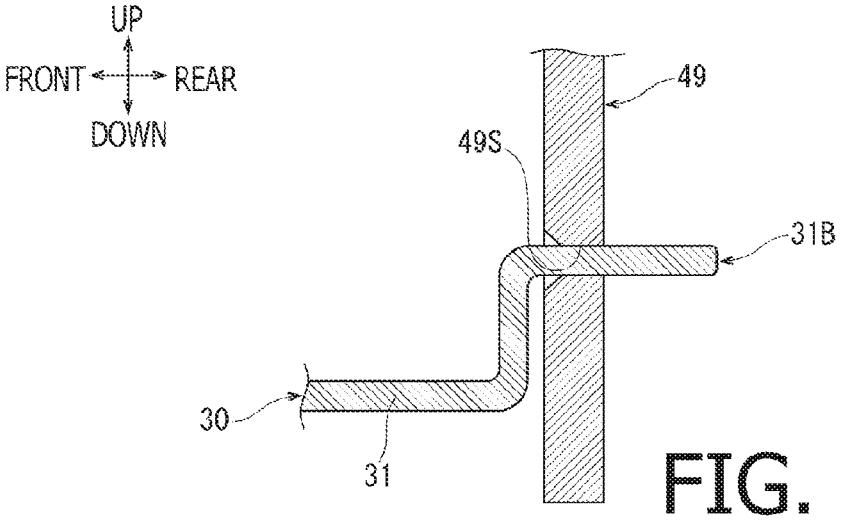
FIG. 11 is a cross-sectional view of the plate member with the rearward end inserted in the slit in the driver frame in the image reading apparatus according to the embodiment of the present disclosure.

As shown in FIG. 6, at a frontward end in the lower chute member 140, at a position in adjacent frontward to the contact face 156, formed is a fastener portion 157. The fastener portion 157 includes, although detailed illustration is omitted, a screw hole and a positioning pin. At a rearward end in the lower chute member 140, at a position in adjacent rearward to the contact face 156, formed is an insertion hole 158. Although detailed illustration is omitted, the insertion hole 158 is formed at a position to coincide with the driver frame 49 along the front-rear direction to confront the driver frame 49 from the front. As shown in FIGS. 10 and 11, at a position in the driver frame 49 to coincide with the insertion hole 158, formed is a slit 49S bored through the driver frame 49 in the front-rear direction.

The plate member 30 may be attached to the lower chute member 140 in a following procedure. That is, as shown in FIG. 6, the plate member 30 may be placed closer to the contact surface 156 in the lower chute member 140. As shown in FIG. 8, the part of the plate member 30 that contains the second face 32 may be inserted in the dent 159, and the first face 31 may be placed to adjoin the contact face 156. In other words, the first face 31 may be placed to contact the lower edges of the rightward parts of the ribs 145S and the lower edges of the cylindrical parts 15T from below.

Thereafter, the rear end portion 31B of the plate member 30 may be inserted in the insertion hole 158 in the lower chute member 140 (see FIG. 6) and further in the slit 49S in the driver frame 49 (see FIGS. 10 and 11). Thereby, the rear end portion 31B of the plate member 30 may contact the driver frame 49 to be supported by the driver frame 49.

On the other hand, the frontend portion 31A of the plate member 30 (see FIG. 9) may be fitted in the fastener portion 157 in the lower chute member 140 (see also FIG. 6). The positioning pin (not shown) in the fastener portion 157 and the positioning hole 31K in the frontend portion 31A may be engaged so that the frontend portion 31A may be placed in a correct position with respect to the lower chute member 140. A screw (not shown) may be inserted in the fastening hole 31H in the frontend portion 31A and screwed into the screw hole (not shown) in the fastener portion 157 so that the frontend portion 31A may be fastened to the lower chute member 140.

Thus, the plate member 30 may be fixed steadily to the lower chute member 140 with the first face 31 placed on the contact face 156 and the second face 32 accommodated in the dent 159. In this arrangement, the plate member 30 is arranged to longitudinally extend in parallel with a longitudinal edge of the opening 140H. A part of the second face 32 of the plate member 30 that extends in the vertical and front-rear directions overlaps the compressive coil spring 55 in a view along the widthwise direction. Further, while the first face 31 of the plate member 30 extends in the front-rear and widthwise directions, the compressive coil spring 55 is arranged within the extending range of the first face 31 in a view along a direction orthogonal to the supporting face 150.

Thereafter, as shown in FIG. 5, the presser member 99 may be attached to the bottom of the lower chute member 140 so that, as shown in FIGS. 3 and 8, the plate member 30 may contact a surface 99B, which is a side opposite from the surface 99A facing the sheet supporting face 81A.

[Structure to Attach the Hinges to the Main Body]

Figure 12:
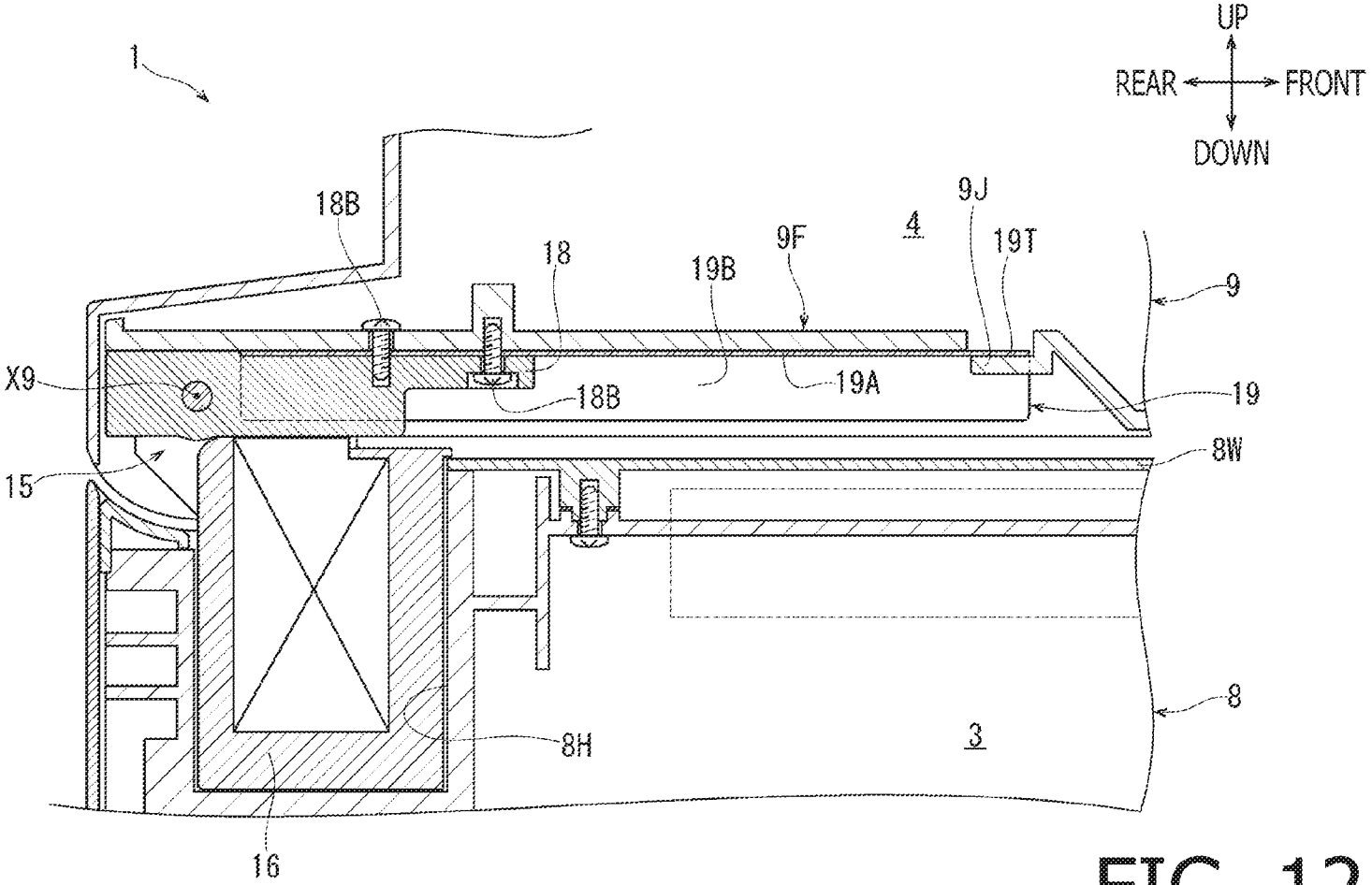
FIG. 12 is a cross-sectional partial view of the image reading apparatus according to the embodiment of the present disclosure viewed along a line A-A shown in FIG. 4.

As shown in FIGS. 4 and 12, each hinge 15 includes a hinge body 16 and a supporting part 18. The following description and FIGS. 4, 12 may describe or show solely one of the hinges 15 on the left. Meanwhile, the hinge 15 on the right is in a substantially identical configuration to the hinge on the left.

The hinge body 16 may be in a rectangular-columnar shape containing a spring and a slider cam (not shown), which may enable a free-stop motion to allow the openable unit 9 to stay open at a desired position.

As shown in FIG. 12, at a rearward position in the main body 8 adjacent to an openable axis X9, formed is a hinge housing 8H. The hinge housing 8H is formed to dent downward from the upper face of the main body 8. The hinge body 16 may be fitted into the hinge housing 8H from above to be supported movably in the vertical direction. Thus, when, for example, the original sheet is a page of a thick book, the hinge body 16 may move upward within the hinge housing 8 according to the thickness of the book.

As shown in FIGS. 4 and 12, the supporting part 18 may be a resin piece formed in a shape of a parallelepiped bar, which may be longer in the front-rear direction than in the widthwise direction. The supporting part 18 is arranged at an upper position with respect to the hinge body 16. The supporting part 18 is supported by the hinge body 16 to be pivotable about the openable axis X9.

As shown in FIG. 12, the supporting part 18 is fixed to a frame member 9F being a part of the cover 9 by a plurality of screws 18B from below. In an intermediate position between the frame member 9F and the supporter part 18, arranged is an enhancing member 19. The enhancing member 19 may be a sheet of metal having a first wall portion 19A and a second wall portion 19B, which are arranged in a cross-sectional shape of an L.

A rearward part of the first wall portion 19A is placed between the frame member 9F and the supporter part 18 and is fastened by a plurality of screws 18B to be bound with the frame member 9F and the supporter part 18. The first wall portion 19A extends along the frame member 9F frontward to be longer than the supporter part 18. A frontend part 19T of the first wall portion 19A engages with an engageable part 9J formed in the frame member 9F. The engageable part 9J contacts a lower surface of the frontend part 19T from below.

The second wall portion 19B is continuous from a rightward edge of the first wall portion 19A. The second wall portion 19B spreads downward and extends longitudinally in the front-rear direction for the same length as the first wall portion 19A.

The enhancing member 19 configured as above may moderate concentration of stress at a part of the frame member 9F that may be supported by the supporter part 18.

[Benefits]

According to the image reading apparatus 1 described above, as shown in, for example, FIG. 8, the lower ends of the compressive coil springs 55 to urge the pinch rollers 52 against the driving rollers 51 are supported by the supporting faces 150 being the upward faces of the bottoms of the spring housings 143 in the lower chute member 140. Meanwhile, the plate member 30 made of metal extends in the front-rear direction and coincides with the contact face 156 located on the opposite side from the supporting face 150 in the lower chute member 140. In particular, the first face 31 of the plate member 30 contacts the lower edges of the ribs 145S and the lower edges of the cylindrical parts 145T from below. Thus, the plate member 30 may effectively enhance the area in the vicinity of the opening 140H and the spring housings 143 in the lower chute member 140. Therefore, while the supporting faces 150 may be affected by reaction force R1 from the urging force of the compressive coil springs 55 over a long period of time, creep deformation in the area in the vicinity of the opening 140H and the spring housings 143 in the lower chute member 140 may be restrained. Therefore, an amount of the urging force of the compressive coil springs 55 may be maintained within a preferable range, and the nipping force between the driving rollers 51 and the pinch rollers 52 may be maintained steadily over a longer period of time.

Thus, in the image reading apparatus 1 according to the present embodiment, discharging ability to discharge the sheets SH by the discharge unit 50 may be preferably maintained, and the image reading operation by the reader sensor 3S may be performed preferably over the longer period of time.

Further, in the image reading apparatus 1 according to the present embodiment, as shown in, for example, FIG. 8, the plate member 30 may be a metal sheet bent to form the cross-sectional shape of an L with the first face 31 and the second face 32. Therefore, compared to a flat plate that does not have, for example, the second face 32, rigidity of the plate member 30 may be improved. Therefore, the area in the vicinity of the opening 140H and the spring housings 143 in the lower chute member 140 may be enhanced by the plate member 30 even more effectively and steadily.

Further, in the image reading apparatus 1 according to the present embodiment, as shown in, for example FIG. 8, the second face 32 protruding upward is accommodated in the dent 159, which is dented upward from the contact face 156 in the lower chute member 140. Therefore, compared to an image reading apparatus, in which the second face 32 is not accommodated in a dent, a height of the image reading apparatus 1 may be effectively reduced.

Further, in the image reading apparatus 1 according to the present embodiment, as shown in FIG. 4, the driver unit 4D and the motor 4M are supported by the driver frame 49. Meanwhile, as shown in FIG. 10, the rear end portion 31B in the plate member 30 is placed to contact the driver frame 49. Therefore, when the activated motor 4M produces heat, the heat may be emitted through the driver frame 49. Further, the heat may be transmitted to the plate member 30 through the driver frame 49 to be emitted outward through the plate member 30. Accordingly, driving ability of the driver unit 4D may be improved; thereby, for example, improved conveying ability to convey the sheets SH continuously in a faster velocity may be achieved.

Further, in the image reading apparatus 1 according to the present embodiment, as shown in FIGS. 10 and 11, the rear end portion 31B in the plate member 30 is inserted in the slit 49S formed in the driver frame 49 so that the plate member 30 may be in contact with the driver frame 49 and be supported by the driver frame 49. Therefore, with the uncomplicated structure, the plate member 30 may be supported, and the heat from the motor 4M may be transmitted efficiently from the driver frame 49 to the plate member 30.

Further, in the image reading apparatus 1 according to the present embodiment, as shown in, for example, FIGS. 3, 6, and 7, the lower chute member 140 forming the bottom face of the openable unit 9 is in a shape that may be thin and may have relatively larger area dimensions. Meanwhile, with the opening 140H formed in the lower chute member 140, rigidity of the lower chute member 140 may be undesirably lowered. In this regard, with the plate member 30, creep deformation in the area in the vicinity of the opening 140H and the spring housings 143 in the lower chute member 140 may be effectively restrained.

Further, in the image reading apparatus 1 according to the present embodiment, as shown in FIGS. 3 and 5, the plate member 30 is placed to contact the surface 99B of the presser member 99, which is opposite from the surface 99A facing the sheet supporting face 81A. Therefore, static electricity accumulative in the presser member 99 may be drawn to the ground wire (not shown) through the plate member 30 and the driver frame 49. Thus, the static electricity accumulative in the presser member 99 may be effectively removed, and the original sheet may be prevented from being attracted to the presser member 99.

Further, in the image reading apparatus 1 according to the present embodiment, as shown in FIG. 6, the length L31 of the first face 31 in the front-rear direction is greater than the dimension L99 of the shorter side of the presser member 99 in the front-rear direction. Therefore, larger dimensions of an area, in which the plate member 30 contacts the presser member 99, may be reserved, and the static electricity accumulative in the presser member 99 may be effectively removed.

MORE EXAMPLES

Although an example of carrying out the invention has been described, those skilled in the art will appreciate that there are numerous variations and permutations of the sheet conveyer that fall within the spirit and scope of the invention as set forth in the appended claims. It is to be understood that the subject matter defined in the appended claims is not necessarily limited to the specific features or act described above. Rather, the specific features and acts described above are disclosed as example forms of implementing the claims.

Figure 13:
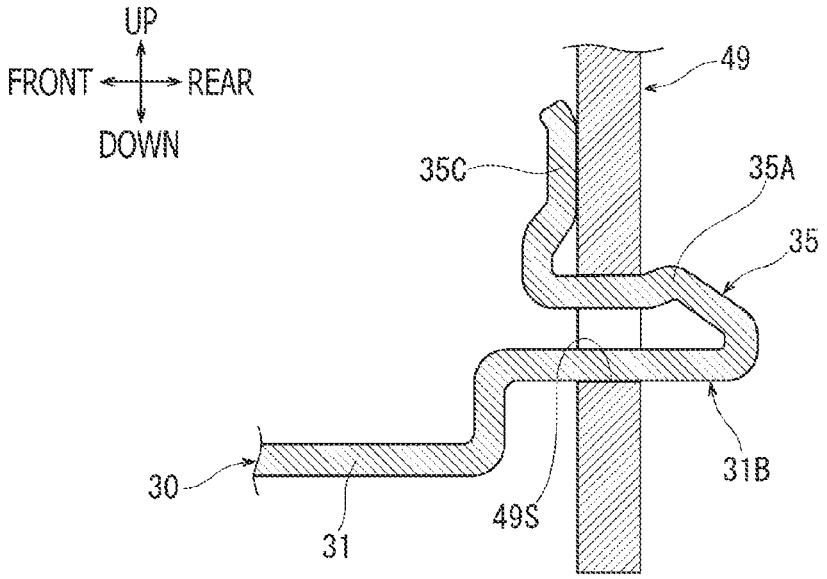
FIG. 13 is a cross-sectional view of the plate member with the rearward end inserted in the slit in the driver frame in a modified example of the image reading apparatus according the embodiment of the present disclosure.

For example, as shown in FIG. 13, the rear end portion 31B of the plate member 30 may include a turn-back portion 35. The turn-back portion 35 may be formed by bending the rear end portion 31B of the plate member 30 upward and then turning to incline upper-frontward. Further, the turn-back portion 35 may be bent to lower-frontward to form a withdrawal stopper 35A. Furthermore, the turn-back portion 35 may be extended frontward and thereafter rearward to extend upward to form a surface-contact portion 35C.

Meanwhile, the slit 49S in the driver frame 49 may be formed to be larger in the vertical direction than the slit 49S shown in the FIG. 11.

The rear end portion 31B in the plate member 30 may be inserted together with the turn-back portion 35 in the slit 49S so that the withdrawal stopper 35A may engage with a circumferential edge of the slit 49S from the rear, and the plate member 30 may be prevented from falling off from the driver frame 49. Meanwhile, an intermediate portion between the rear end portion 31B and the turn-back portion 35 may contact the circumferential edge of the slit 49S. Further, the surface-contact portion 35C may be resiliently deformed to contact a frontward face of the driver frame 49 by the surface. Thus, with the increased contacting areas between the plate member 30 and the driver frame 49, the heat from the motor 4M may be emitted through the driver frame 49 and the plate member 30 even more efficiently.

For another example, the shape of the plate member may not necessarily be limited to that described above but may include, for example, a plane plate member, a channeling member, and an angled member.

For another example, the compressive coil springs 55 may be replaced with any elastic member including torsion coil springs and rubber pieces, as long as the elastic member may produce an urging force.

For another example, the frontend part 19T in the plate member 30 may not necessarily be engaged with the engageable part 9J formed in the frame member 9F but may be placed to contact the driver frame 49. For another example, the frontend part 19T may be fastened to the driver frame 49 by a screw so that the frontend part 19T may contact the driver frame 49 by the surface to be supported by the driver frame 49.

For another example, the present disclosure may not necessarily be employed in an image reading apparatus but may be employed in, for example, an image forming apparatus and a multifunction peripheral device.

For another example, the guiding faces, including the fourth guiding face 134, and the contact face 156 may not necessarily be limited to the faces that spread hypothetically along the edges of the ribs or the cylindrical parts but may include substantial surfaces spreading along the positions of the edges of the ribs or the cylindrical parts.

What is claimed is:

1. A sheet conveying apparatus, comprising:

a conveyer configured to convey a sheet in a predetermined conveying direction along a predetermined conveyer path; and a discharger configured to discharge the sheet from the conveyer path, wherein the discharger comprises:

a driving roller;

a pinch roller arranged to confront the driving roller across the conveyer path; and an urging member configured to urge the pinch roller against the driving roller;

wherein the conveyer comprises a chute member, the chute member comprising:

a guiding face defining a part of the conveyer path;

a supporting face configured to support one end of the urging member; and a contact face located on a particular face of the chute member opposite from the supporting face;

wherein the sheet conveying apparatus further comprises a plate member made of metal, the plate member being arranged to extend in a direction intersecting with the conveying direction and to contact the contact face;

wherein the conveyer further comprises:

a driver frame made of metal, the driver frame being arranged at one end of the chute member in a widthwise direction orthogonal to the conveying direction; and a driver unit supported by the driver frame, the driver unit being configured to drive the driving roller by a motor;

wherein an end portion of the plate member on one end in the widthwise direction contacts the driver frame; and wherein the end portion of the plate member is in contact with and supported by the driver frame by being inserted in a slit formed in the driver frame.

2. The sheet conveying apparatus according to claim 1, wherein the plate member is a sheet of metal formed by bending to have a first face extending along the contact face and a second face intersecting with the first face.

3. The sheet conveying apparatus according to claim 2, wherein the second face protrudes in a direction toward the conveyer path; and wherein the chute member comprises a dent to accommodate the second face.

4. The sheet conveying apparatus according to claim 2, wherein a part of the second face of the plate member overlaps the urging member in a view along the conveying direction.

5. The sheet conveying apparatus according to claim 2, wherein the first face of the plate member extends along the widthwise direction and the conveying direction; and wherein the urging member is arranged within a range of the first face of the plate member along the widthwise direction and the conveying direction in a view along a direction orthogonal to the supporting face.

6. The sheet conveying apparatus according to claim 1, further comprising:

an image reader arranged upstream of the discharger in the conveyer path with regard to the conveying direction, the image reader being configured to read an image of the sheet being conveyed along the conveyer path.

7. The sheet conveying apparatus according to claim 6, further comprising:

a first housing configured to accommodate the conveyer; and a second housing arranged in a lower position with respect to the first housing, the second housing being configured to accommodate the image reader, the second housing comprising a sheet supporting face configured to support an original sheet with an image to be read by the image reader, wherein the first housing is movable between a first position, in which the first housing covers the sheet supporting face, and a second position, in which the sheet supporting face is exposed;

wherein the chute member forms a bottom face of the first housing, the bottom face covering the sheet supporting face under a condition where the first housing is in the first position; and wherein the chute member is partly cut out to form an opening in a range above a position where the image reader stays at a predetermined stationary readable position.

8. The sheet conveying apparatus according to claim 7, wherein the plate member is arranged to extend in parallel with a longitudinal edge of the opening.

9. The sheet conveying apparatus according to claim 7, further comprising:

a presser member arranged on the bottom face of the first housing, the presser member being configured to press the original sheet supported by the sheet supporting face under the condition where the first housing is in the first position, wherein the plate member contacts a surface of the presser member opposite from a surface that confronts the sheet supporting face.

10. The sheet conveying apparatus according to claim 9, wherein the presser member has a shorter side and a longer side; and wherein a length of the plate member in the direction intersecting with the conveying direction is greater than a length of the shorter side of the presser member.

11. A sheet conveying apparatus, comprising:

a conveyer configured to convey a sheet along a predetermined conveyer path;

a driver frame made of metal, the driver frame being configured to support a driver unit that is configured to drive the conveyer; and a discharger configured to discharge the sheet from the conveyer path, wherein the conveyer comprises a chute member, the chute member comprising a guiding face that defines a part of the conveyer path;

wherein the sheet conveying apparatus further comprises a plate member arranged to adjoin a particular face located on a side of the chute member opposite from the guiding face;

wherein the plate member is arranged to extend in a direction orthogonal to a predetermined conveying direction, in which the sheet is conveyed by the conveyer;

wherein the plate member is arranged to contact the driver frame at an end portion thereof;

wherein a slit is formed in the driver frame; and wherein the end portion of the plate member is inserted in the slit to contact the driver frame.

* * * * *